US011066794B2

(12) United States Patent
Neusch

(10) Patent No.: US 11,066,794 B2
(45) Date of Patent: Jul. 20, 2021

(54) BRACE FOR ERECTING A BOLLARD FENCE

(71) Applicant: NEUSCH INNOVATIONS, LP, Marble Falls, TX (US)

(72) Inventor: William H Neusch, Marble Falls, TX (US)

(73) Assignee: Neusch Innovations, LP, Marble Falls, TX (US)

( * ) Notice: Subject to any disclaimer, the term of this patent is extended or adjusted under 35 U.S.C. 154(b) by 0 days.

(21) Appl. No.: 16/907,716

(22) Filed: Jun. 22, 2020

(65) Prior Publication Data

US 2020/0325702 A1 Oct. 15, 2020

Related U.S. Application Data

(63) Continuation of application No. 16/366,273, filed on Mar. 27, 2019, now Pat. No. 10,689,819.

(60) Provisional application No. 62/712,468, filed on Jul. 31, 2018, provisional application No. 62/648,453, filed on Mar. 27, 2018.

(51) Int. Cl.

| | |
|---|---|
| ***E01F 15/04*** | (2006.01) |
| ***E04C 3/06*** | (2006.01) |
| ***E04H 17/22*** | (2006.01) |
| ***E04H 17/14*** | (2006.01) |
| ***E04H 17/26*** | (2006.01) |

(52) U.S. Cl.

CPC ..... *E01F 15/0461* (2013.01); *E01F 15/0476* (2013.01); *E04C 3/06* (2013.01); *E04H 17/1417* (2013.01); *E04H 17/22* (2013.01); *E04H 17/263* (2013.01); *E01F 15/0407* (2013.01)

(58) Field of Classification Search

CPC .... E05F 15/0461; E05F 15/0476; E04C 3/06; E04H 17/22

See application file for complete search history.

(56) References Cited

U.S. PATENT DOCUMENTS

| | | | | | |
|---|---|---|---|---|---|
| 657,627 | A * | 9/1900 | Turner | E04H 12/08 | 52/152 |
| 1,038,573 | A * | 9/1912 | Harrison | E04H 12/08 | 52/152 |
| 2,849,202 | A * | 8/1958 | McCombs | E04H 12/2238 | 248/515 |
| 3,817,006 | A * | 6/1974 | Williams | E04G 21/26 | 52/127.2 |
| 4,000,592 | A * | 1/1977 | Kelly | E04G 21/26 | 52/149 |
| 6,752,570 | B2 * | 6/2004 | Lanka | E04G 21/26 | 405/272 |
| 7,137,608 | B2 * | 11/2006 | Willey | F16M 11/046 | 248/519 |

(Continued)

*Primary Examiner* — Beth A Stephan

(74) *Attorney, Agent, or Firm* — Shackelford, Bowen, McKinley & Norton, LLP; Henry L. Ehrlich

(57) ABSTRACT

A bollard panel having adjacent bollards and a gap between the adjacent bollards, a brace having a panel connector, a first longitudinal section, and a second longitudinal section, and the brace supporting the bollard panel in a vertical position relative to a ground with the brace disposed in the gap with the first longitudinal section located on a first side of the bollard panel, the second longitudinal section located on a second side of the bollard panel, and the panel connector attached to the bollard panel.

20 Claims, 20 Drawing Sheets

(56) References Cited

U.S. PATENT DOCUMENTS

| | | | | |
|---|---|---|---|---|
| 7,739,842 | B1 * | 6/2010 | Hodsdon | E04G 21/26 52/127.2 |
| 8,015,759 | B1 * | 9/2011 | Bruce | G09F 7/18 52/146 |
| 8,322,106 | B2 * | 12/2012 | Simmons | E04H 12/2238 52/652.1 |
| 8,782,970 | B2 * | 7/2014 | Griffiths | E02D 5/74 52/155 |
| 10,689,819 | B2 * | 6/2020 | Neusch | E01F 15/0461 |
| 2006/0179728 | A1 * | 8/2006 | Lang | E04G 21/26 52/127.2 |

* cited by examiner

BRACE FOR ERECTING A BOLLARD FENCE

BACKGROUND

This section provides background information to facilitate a better understanding of the various aspects of the disclosure. It should be understood that the statements in this section of this document are to be read in this light, and not as admissions of prior art.

Bollard fences or barriers are constructed of metal tubular members that are spaced laterally apart a sufficient distance to permit sight across the barrier and to allow water to pass through the barrier while preventing the passage of people through the gap. The bollards are often constructed of heavy steel pipe ranging in length from twenty to forty feet and more and which may be filled with material such as concrete. Erecting the bollards to form a lengthy barrier can be a tedious and time consuming endeavor.

SUMMARY

An exemplary brace for supporting a bollard panel in a vertical position includes a linear structure having an arch section that includes a panel connector to secure the brace to the bollard panel, a first longitudinal section extending in a first axial direction away from the arch section, and a second longitudinal section extending in a second axial direction away from the arch section. When attached to a bollard panel the brace extends generally perpendicular to the bollard panel with the first longitudinal section located on a first side of the bollard panel and the second longitudinal section located on a second side of the bollard panel.

Another exemplary brace for supporting a bollard panel in a vertical position includes a linear member carrying a lower panel connector and separating a first longitudinal section from a second longitudinal section, and a diagonal member having a bottom end pivotally connected to the first longitudinal section and a top end carrying an upper panel connector configured to attach to the bollard panel above the lower panel connector. When the lower panel connector is attached to the bollard panel the brace extends generally perpendicular to the bollard panel with the first longitudinal section located on a first side of the bollard panel and the second longitudinal section located on a second side of the bollard panel.

An exemplary apparatus includes a bollard panel having adjacent bollards and a gap between the adjacent bollards, a brace having a panel connector, a first longitudinal section, and a second longitudinal section, and the brace supporting the bollard panel in a vertical position relative to a ground with the brace disposed in the gap with the first longitudinal section located on a first side of the bollard panel, the second longitudinal section located on a second side of the bollard panel, and the panel connector attached to the bollard panel.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

FIGS. 13 to 15 illustrate using the brace to erect a vertical bollard fence experiencing earthen trench cave-in.

DETAILED DESCRIPTION

Figure 1:
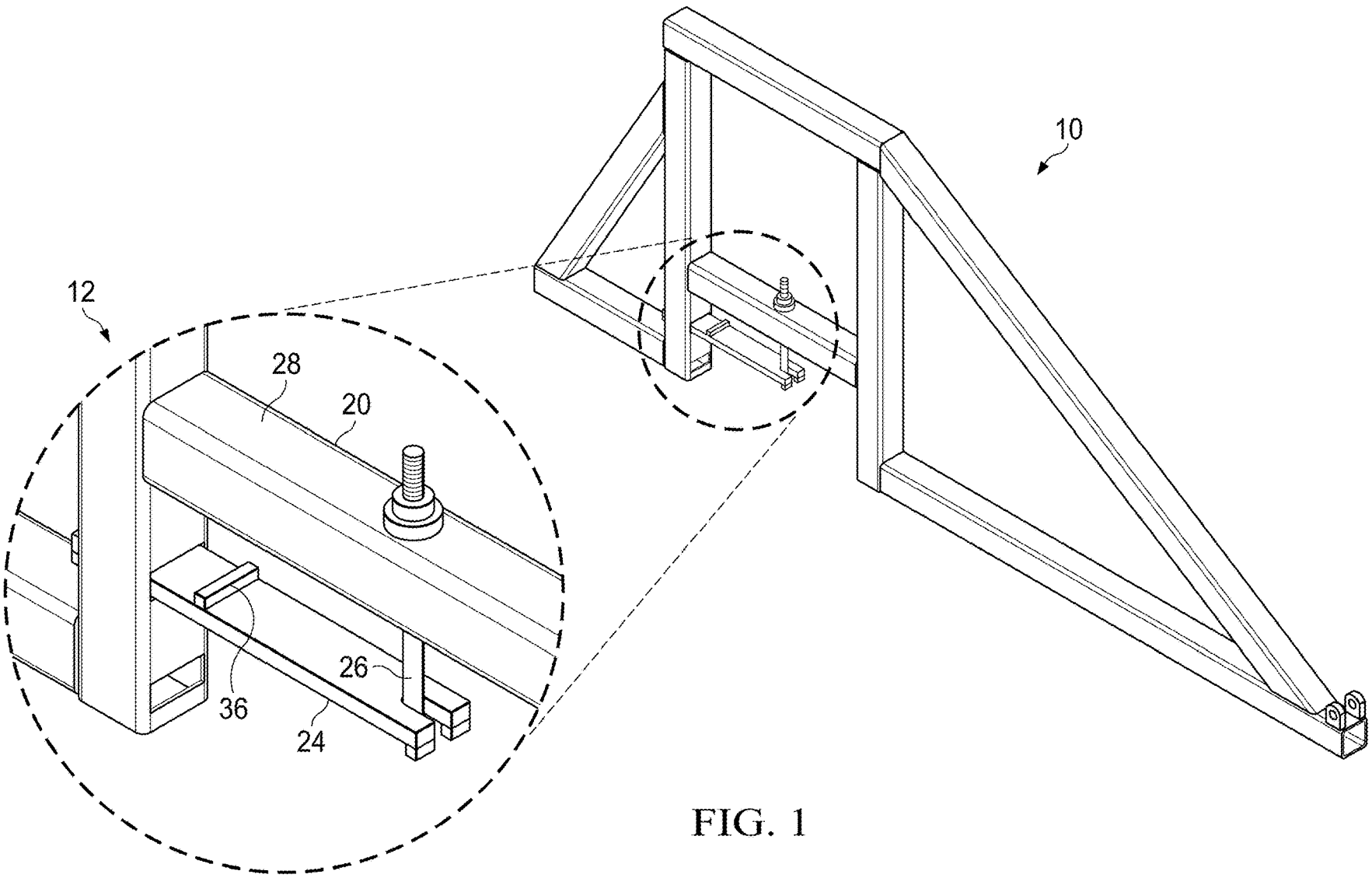
FIG. 1 is an isometric view of a brace for erecting a vertical bollard panel in accordance to aspects of the disclosure.
Figure 2A:
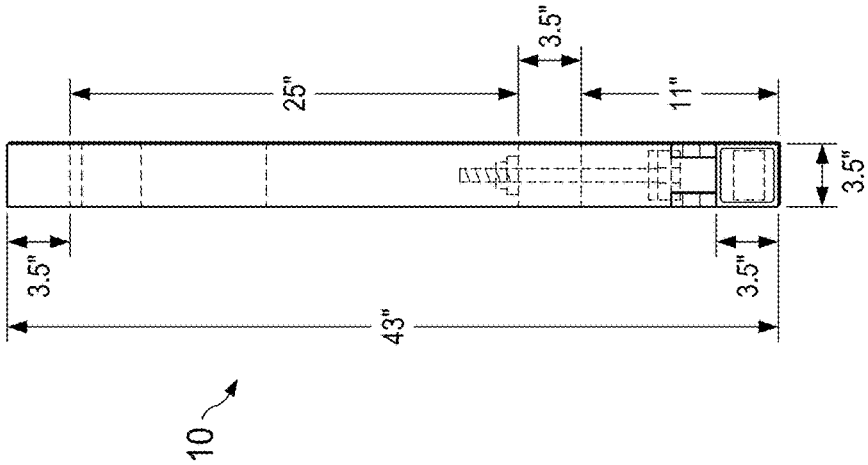
FIGS. 2 and 2A illustrate an exemplary brace for erecting a vertical bollard panel in accordance to aspects of the disclosure.

It is to be understood that the following disclosure provides many different embodiments, or examples, for implementing different features of various illustrative embodiments. Specific examples of components and arrangements are described below to simplify the disclosure. These are, of course, merely examples and are not intended to be limiting. For example, a figure may illustrate an exemplary embodiment with multiple features or combinations of features that are not required in one or more other embodiments and thus a figure may disclose one or more embodiments that have fewer features or a different combination of features than the illustrated embodiment. Embodiments may include some but not all the features illustrated in a figure and some embodiments may combine features illustrated in one figure with features illustrated in another figure. Therefore, combinations of features disclosed in the following detailed description may not be necessary to practice the teachings in the broadest sense and are instead merely to describe particularly representative examples. In addition, the disclosure may repeat reference numerals and/or letters in the various examples. This repetition is for the purpose of simplicity and clarity and does not itself dictate a relationship between the various embodiments and/or configurations discussed.

Bollard fences may be utilized to provide a security perimeter to prevent or limit the ability of vehicles and pedestrians to enter a protected area. Bollard fences are adapted for use in locations that are not in physical view of security personnel and/or in which the response time for security personnel to respond to an attempted breach is delayed. For example, the bollard fence may be used to protect areas that do not have security personnel on-site and large geographic areas such as airports, rail depots, seaports, manufacturing facilities, refineries, power generation facilities, and national border crossings. Accordingly, various embodiments of the bollard fence are configured to provide protection against ramming by a motor vehicle, to limit penetration by pedestrians, and/or provide anti-tampering features.

Figure 4:
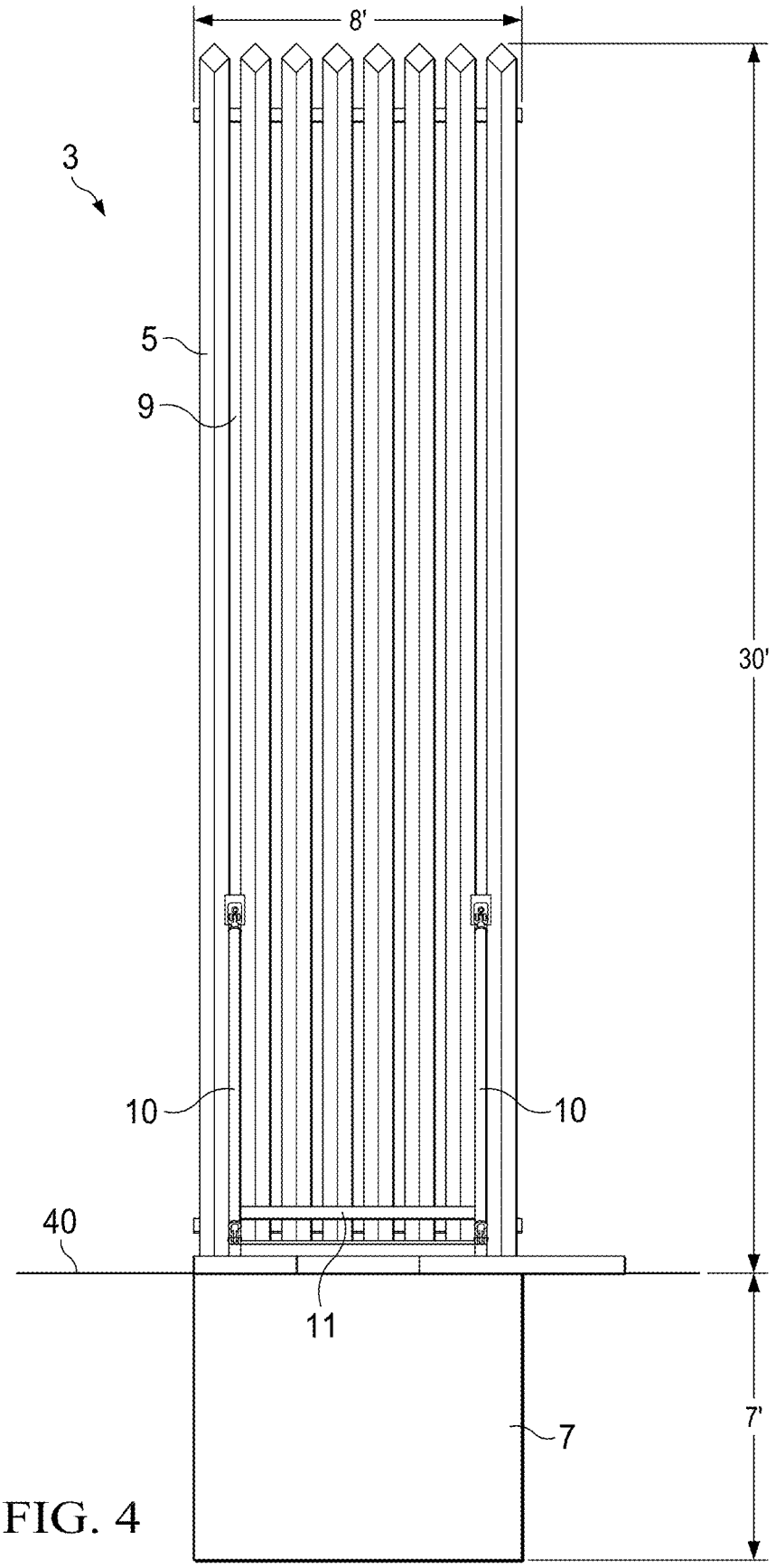
FIG. 4 is an elevation view of a lateral length of an exemplary bollard fence panel supported in a vertical position by a pair of braces in accordance to aspects of the disclosure.
Figure 5:
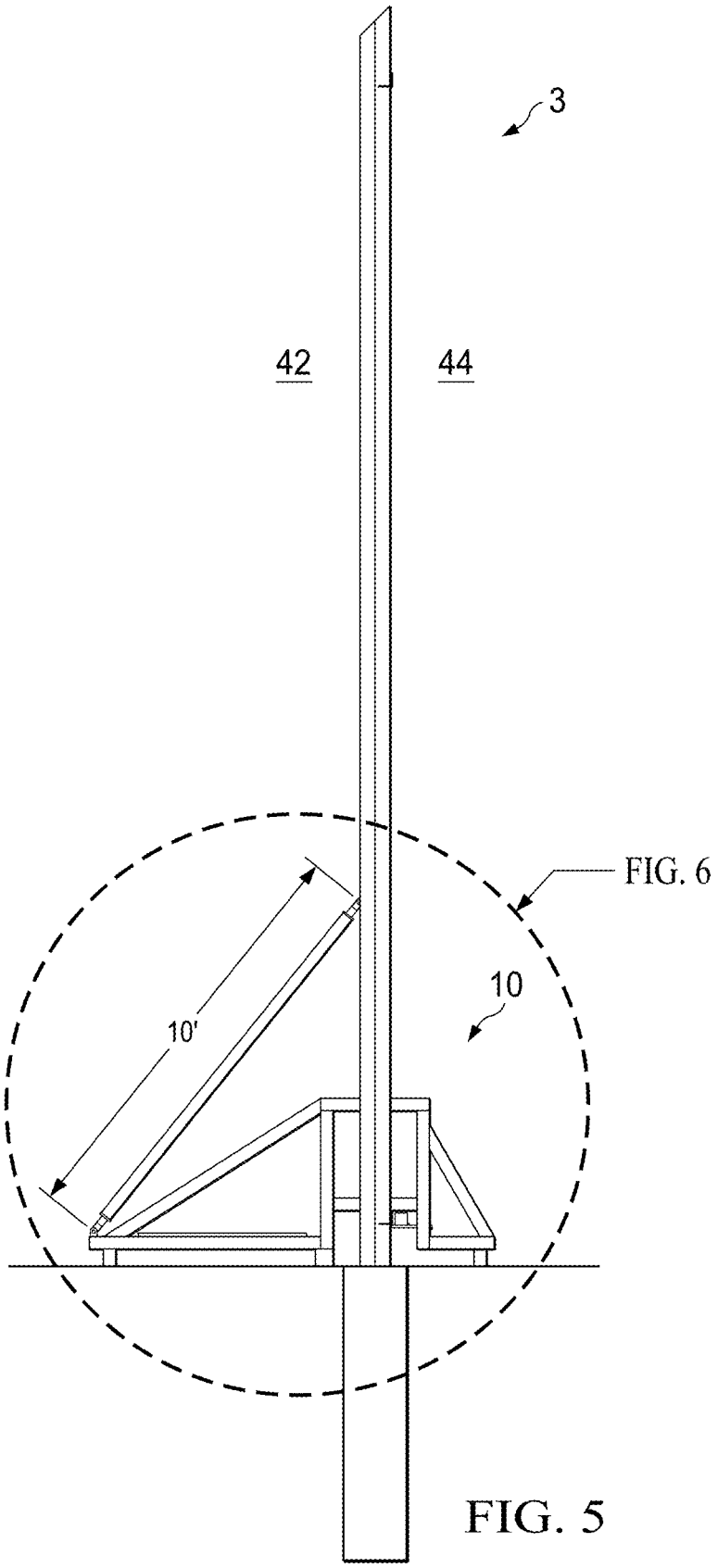
FIG. 5 is a side elevation view of the lateral length of bollard fence panel illustrated in FIG. 4 supported in a vertical position by a pair of braces in accordance to aspects of the disclosure.

Bollard fence or bollard panel 3 is used herein to generally refer to a section or panel of bollard fencing that that comprises two or more elongated metal bollards 5 (e.g., pipe, square tubing) that are spaced apart, leaving an open gap 9 between adjacent bollards 5, and interconnected so as to extend vertically when mounted in an earthen foundation. In accordance to an example, the bollard fence extends greater than ten feet above grade when erected. In accordance to some of the illustrated embodiments, the bollards extend about thirty feet above grade level. A non-limiting example of a bollard fence panel is illustrated in FIG. 4. In FIG. 4, bollard panel 3 comprises a plurality of elongated bollards 5 arranged in a plane and spaced apart such that an open gap 9 exists between the adjacent bollards. The bottom end 13 (FIG. 6) of bollards 5 may be set in a concrete base 7 prior to being installed in the earthen foundation. The top surface of the concrete base may at grade level when installed in the earth. A lower lateral support 11, shown and described herein as angle iron, is fixedly connected to the bollards above and proximate to the grade level. An exemplary embodiment of bollard panel has a lateral length of about eight feet, extending about thirty feet above grade and about seven feet or more below grade, and weighing about 800 pounds. Non-limiting bollard panel examples are described in U.S. published application 2018/0347227, the teachings of which are incorporated herein.

Figure 2:
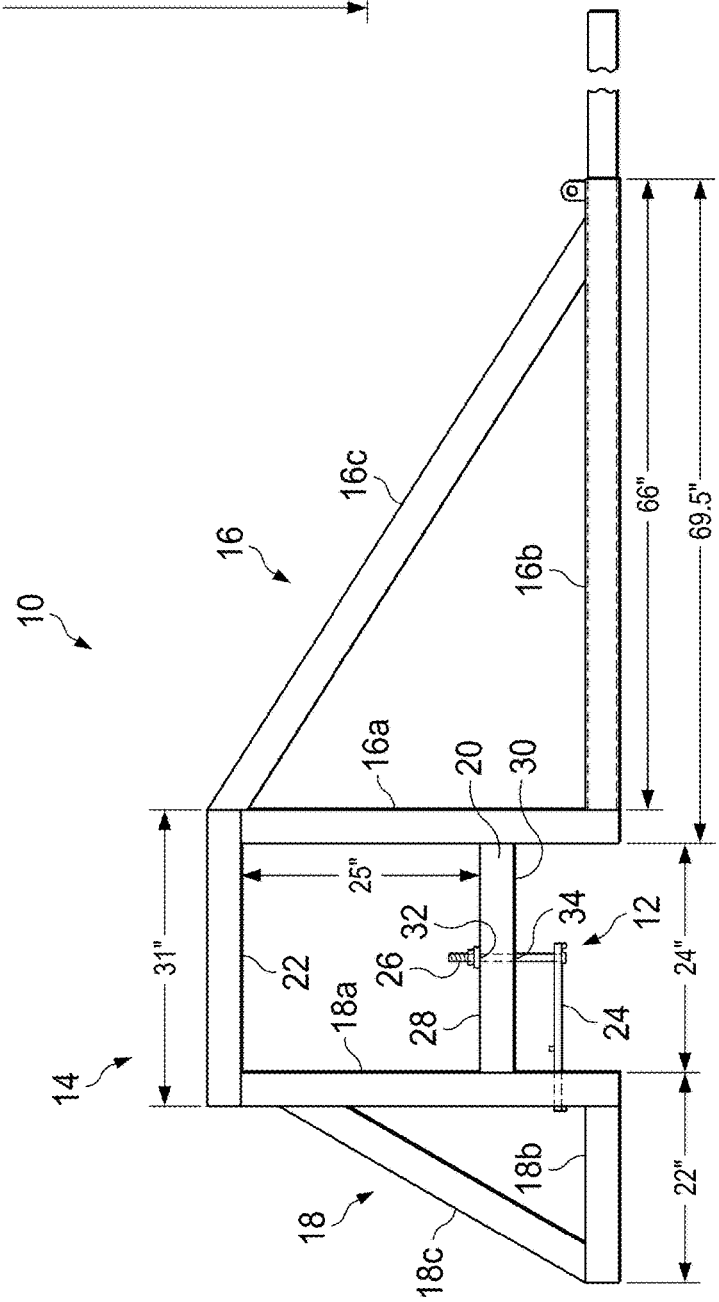

Referring first to FIGS. 1, 2, 2A, and 3 illustrating aspects of an exemplary brace 10 configured to support a bollard panel during installation of the bollard panel in the ground. FIG. 1 is an isometric view of an exemplary brace 10 and an expanded view of an exemplary panel connector 12. FIG. 2 is a plan view of an exemplary brace 10 and 2A is an end view of exemplary brace 10. Brace 10 is a linear extending, or planar, structure having a vertical arch section 14 that includes panel connector 12, a first longitudinal section 16 extending in a first axial direction away from arch section 14 and a second longitudinal section 18 extending in a second axial direction away from arch section 14. According to at least one embodiment, brace 10 can be generally described as a queen post truss. First and second longitudinal sections 16, 18 are constructed of metal members interconnected in a right triangle. First longitudinal section 16 has a vertical leg 16*a* connected at a right angle to horizontal leg 16*b* and a third, or hypotenuse, leg 16*c*. Similarly, second longitudinal section 18 has a vertical leg 18*a* connected at a right angle to horizontal leg 18*b* and a third, or hypotenuse, leg 18*c*. Horizontal legs 16*b* and 18*b* may have different lengths. Arch section 14 is formed by at least one horizontal beam 20 interconnecting vertical legs 16*a*, 18*a*. In the illustrated example, arch section 14 includes a second horizontal member 22 connecting vertical legs 16*a*, 18*a* at their respective top. In this exemplary brace 10, longitudinal sections 16, 18 are constructed of hollow structural steel members. For example, longitudinal sections 16, 18 are constructed of 3.5 inch by 3.5 inch, 11 gauge hollow structure steel tubing.

Figure 3:
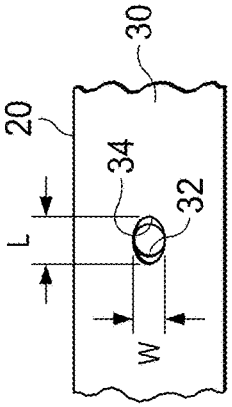
FIG. 3 is a bottom view of a portion of an exemplary panel connector assembly.

An exemplary bollard panel connector 12 includes arch horizontal member 20 (e.g., a fixed jaw), a jaw member 24 extending parallel to horizontal member 20, from at least one of vertical leg 16*a* or vertical leg 18*a* and moveable relative to horizontal member 20, and a tendon 26 connecting horizontal member 20 and jaw 24. In FIG. 2, jaw member 24 is a flat metal bar, e.g., 2.5 inch by 0.75 inches. Tendon 26, shown as a rod or bolt, extends between and connects jaw member 24 and horizontal member 20. Tendon 26 is configured to adjust the distance between moveable jaw member 24 and horizontal member 20, for example, by the threading of a nut on tendon 26 to move moveable jaw member 24. In the illustrated exemplary embodiment, an opening is formed through the top surface 28 and the bottom surface 30 of horizontal member 20 to position tendon 26. FIG. 3 illustrates a bottom view of horizontal member 20 showing bottom surface 30. With reference to FIG. 3, in an exemplary embodiment the opening is formed by a circular hole 32 in top surface 28 and a slot 34 in bottom surface 20. For example, for a tendon 26 having a diameter of 0.75 inches, hole 32 may have a diameter of approximately 1.0 inch and a slot 34 may have a width "W" of approximately 0.875 inches and a length "L" of about 1.25 inches. A stop 36 may be located on jaw member 24 and spaced away from tendon 26.

Using exemplary brace 10 to support a bollard panel 3 for installation is now described with reference to FIGS. 4-12. During installation, a trench 38 is formed in the earth 40 and a bollard panel 3 is positioned by a crane with the lower end of the bollard panel, which may include the pre-formed concrete base 7, in trench 38. A brace 10, or cooperative pair of braces 10, is secured to bollard panel 3 for example before or after the bollard panel is positioned in the trench. Brace 10 is positioned with arch section 14 in a gap 9 between adjacent bollards 5. Brace 10 extends generally perpendicular to bollard panel 3 with first longitudinal section 16 located on a first side 42 of the bollard panel 3 and second longitudinal section 18 located on the opposite, second side 44 of bollard panel 3. All or part of horizontal legs 16*b*, 18*b*, are positioned on ground 40, with blocking 54 as necessary to support bollard panel 3 in the desired vertical position while adjacent bollard panels 3 are positioned in the trench, the adjacent bollard sections are aligned and interconnected, and the trench is filled. FIG. 10 illustrates multiple bollard panels 3 aligned during construction of a bollard fence 56.

Figure 6:
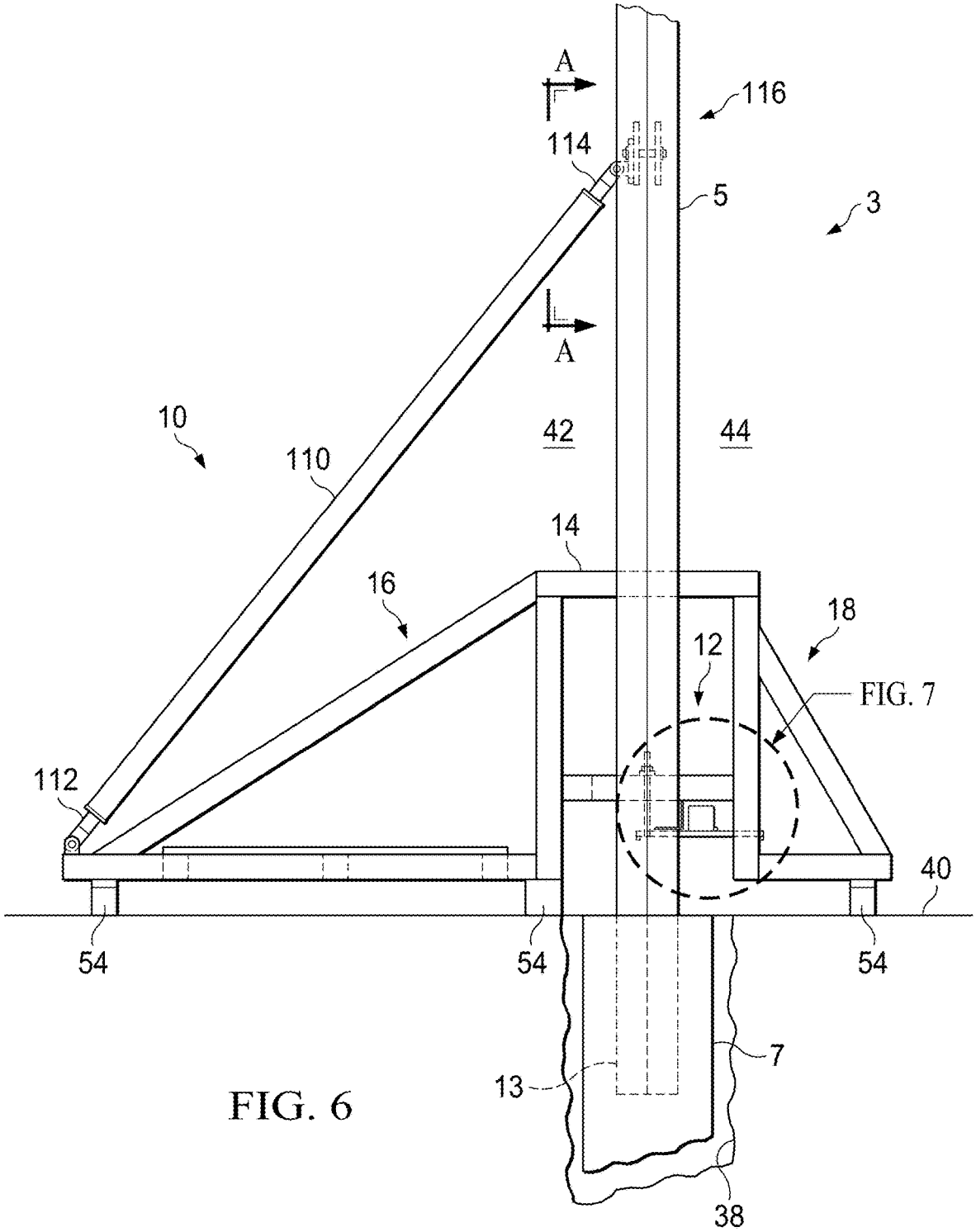
FIG. 6 is a detail view of the brace shown in FIG. 5.
Figure 7:
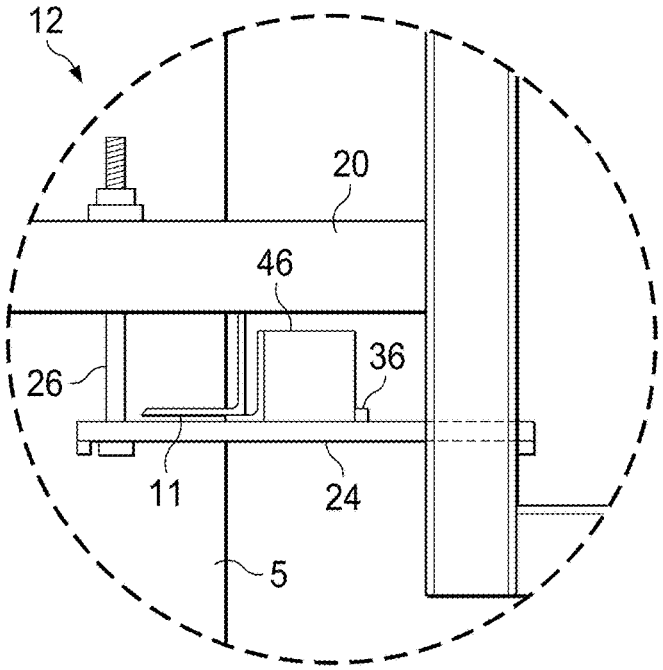
FIG. 7 is a detailed view of the exemplary connector assembly in FIG. 6 according to one or more aspects of the disclosure.

FIGS. 6 and 7 illustrate an example of panel connector 12 securing brace 10 to bollard panel 3. Panel connector 12 is attached and secured to a lateral support 11 of bollard panel 3. Lateral support 11, e.g., angle iron, is attached to bollards 5 and extends generally perpendicular to bollards 5. Lateral support 11 may be for example welded to bollards 5. Lateral support 11 is positioned closer to ground level than to the top end of bollard panel 3.

Lateral support 11 is positioned between horizontal beam 20 and jaw member 24 and horizontally between tendon 26 and stop 36. In the example illustrated in FIG. 7, stop 36 is enlarged vertically and horizontally by positioning and securing a tube 46 on jaw member 24. Lateral support 11 is placed in contact with stop 36, tendon 26, horizontal beam 20, and jaw member 24. Tendon 26 can be moved along the axis of horizontal beam 20 and jaw member 24 to grip lateral support 11 between tendon 26 and stop 36 and tendon 26 can be threaded to grip lateral support 11 between horizontal beam 20 and jaw member 24.

Figure 8:
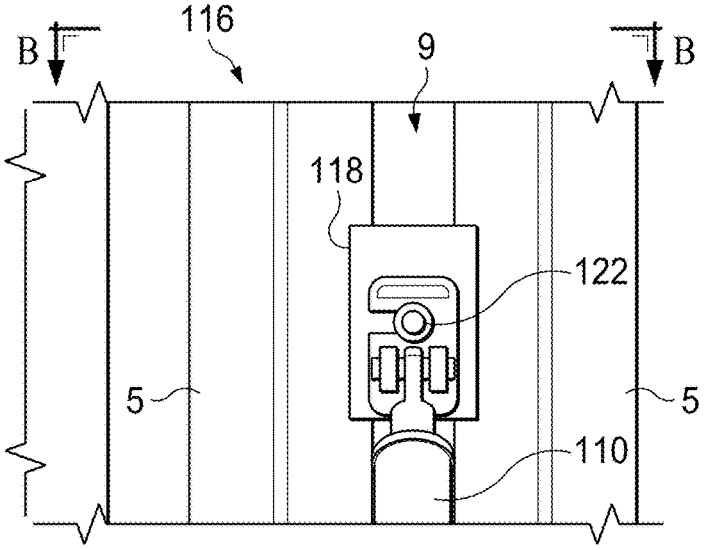
FIG. 8 is view along the line A-A of FIG. 6 illustrating a connection of the brace to the bollard panel at an upper position according to one or more aspects of the disclosure.
Figure 9:
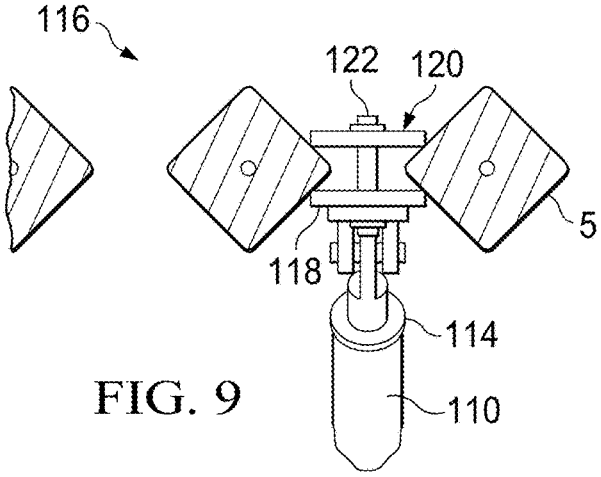
FIG. 9 is a view along the line B-B of FIG. 8 of a section of a bollard fence according to one or more aspects of the disclosure.
Figure 10:
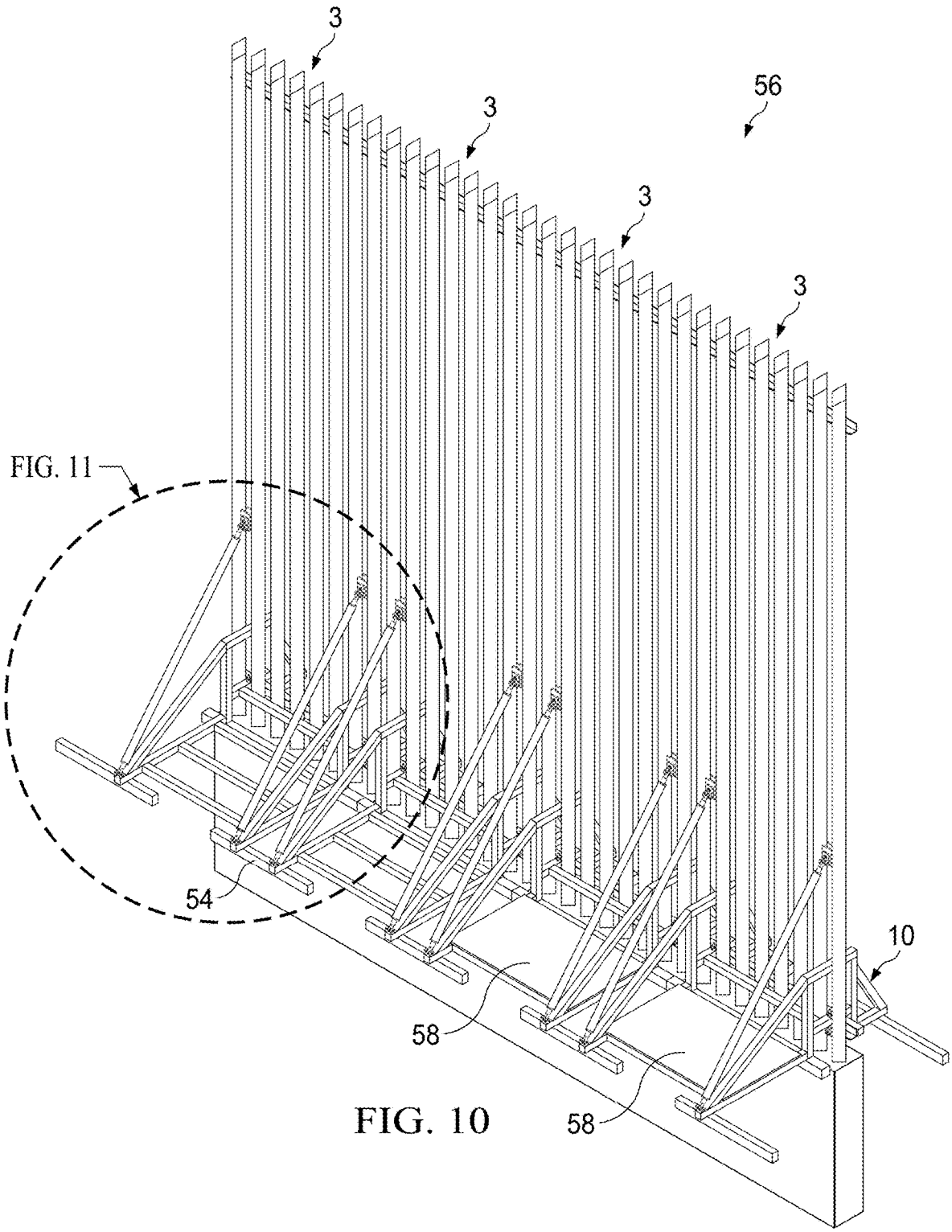
FIG. 10 is an isometric view a lateral run of multiple bollard panels vertically supported by exemplary braces in accordance to aspects of the disclosure.

With reference in particular to FIGS. 6, 8, and 9, an additional diagonal brace 110 may be secured at a bottom end 112 to one of the first and the second longitudinal sections 16, 18 and at a top end 114 to bollard panel 3. Top end 114 may be attached to bollard panel 3 using, for example, a panel connector 116. An exemplary panel connector 116 includes a fixed jaw 118 and a moveable jaw 120 interconnected, for example, by a rod or threaded bolt 122. Fixed jaw 118 and moveable jaw 120 are positioned on opposite sides of the bollard panel and span gap 9 to grip adjacent bollards 5.

Figure 11:
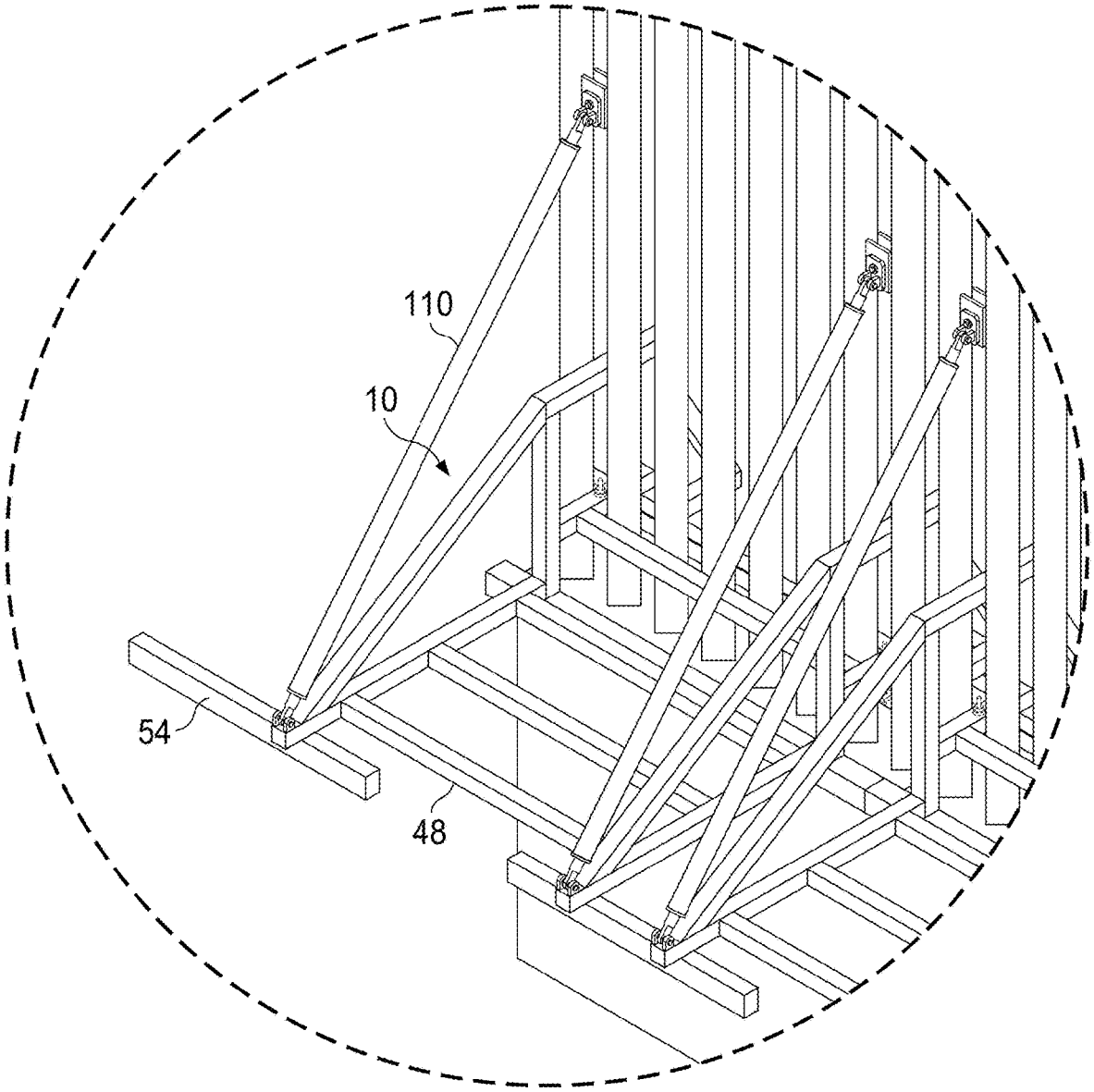
FIG. 11 is a detail view of braces of FIG. 10.
Figure 12:
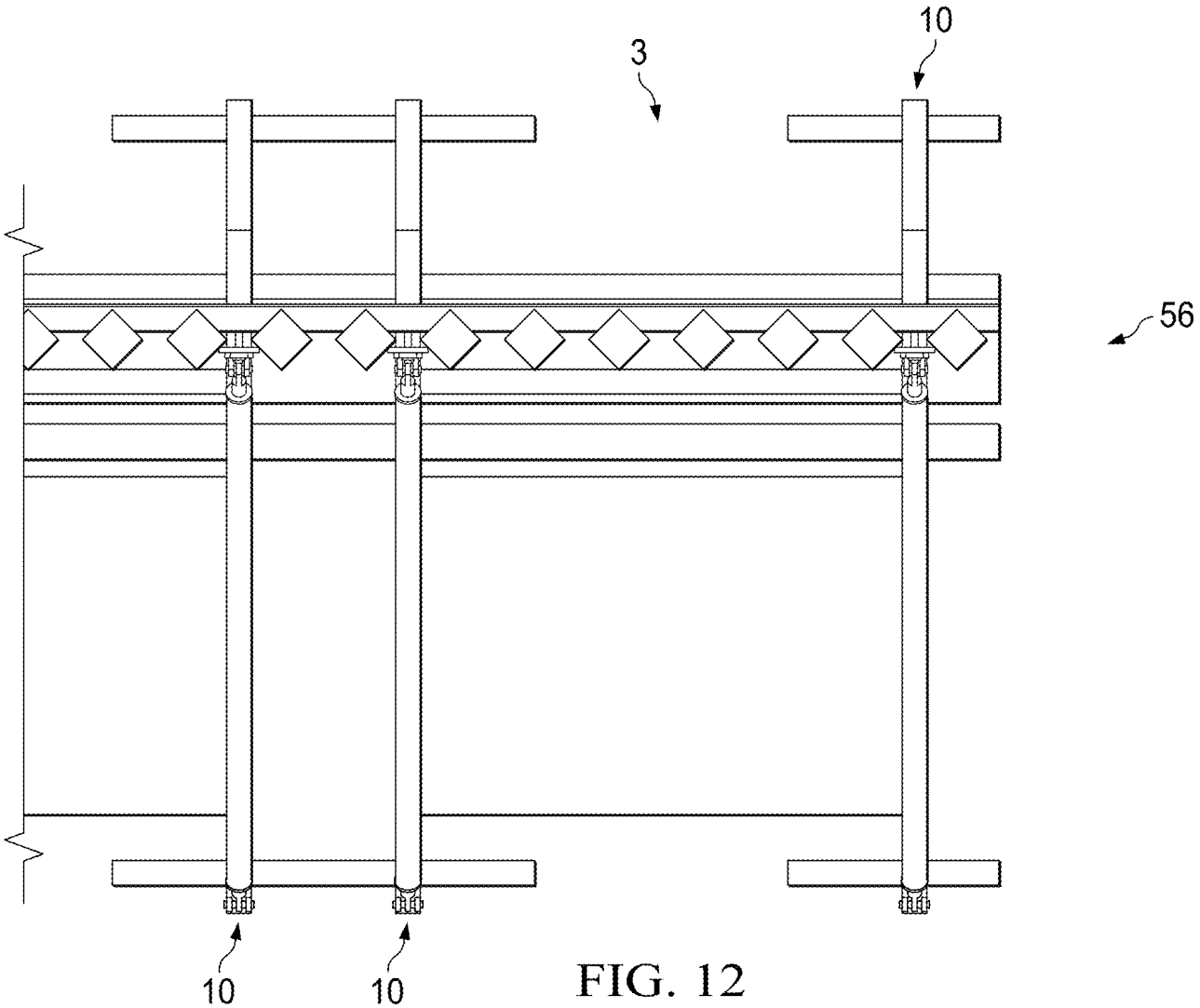
FIG. 12 is a plan view of a portion of the lateral run illustrated in FIG. 10.

In an exemplary installation, see, e.g., FIGS. 10-12, braces 10 are utilized in pairs to orient each bollard panel 3 in a vertical position. The pair of braces may be connected by one or more lateral struts 48, see, e.g., FIG. 11, extending between the respective horizontal legs **16*b* for example of the long longitudinal sections 16. A platform 58, such as plywood, may be positioned atop lateral struts 48**.

Figure 13:
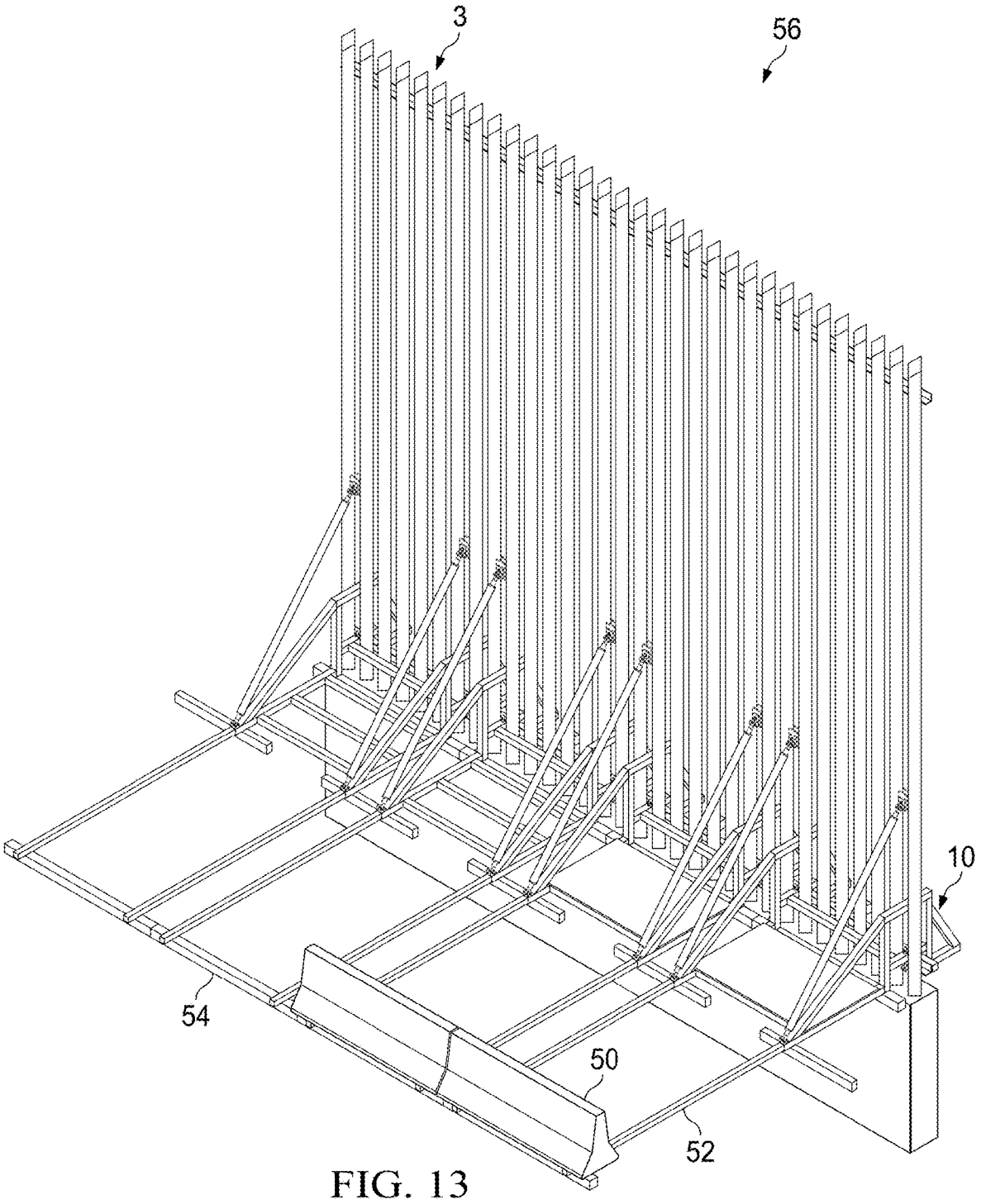
Figure 14:
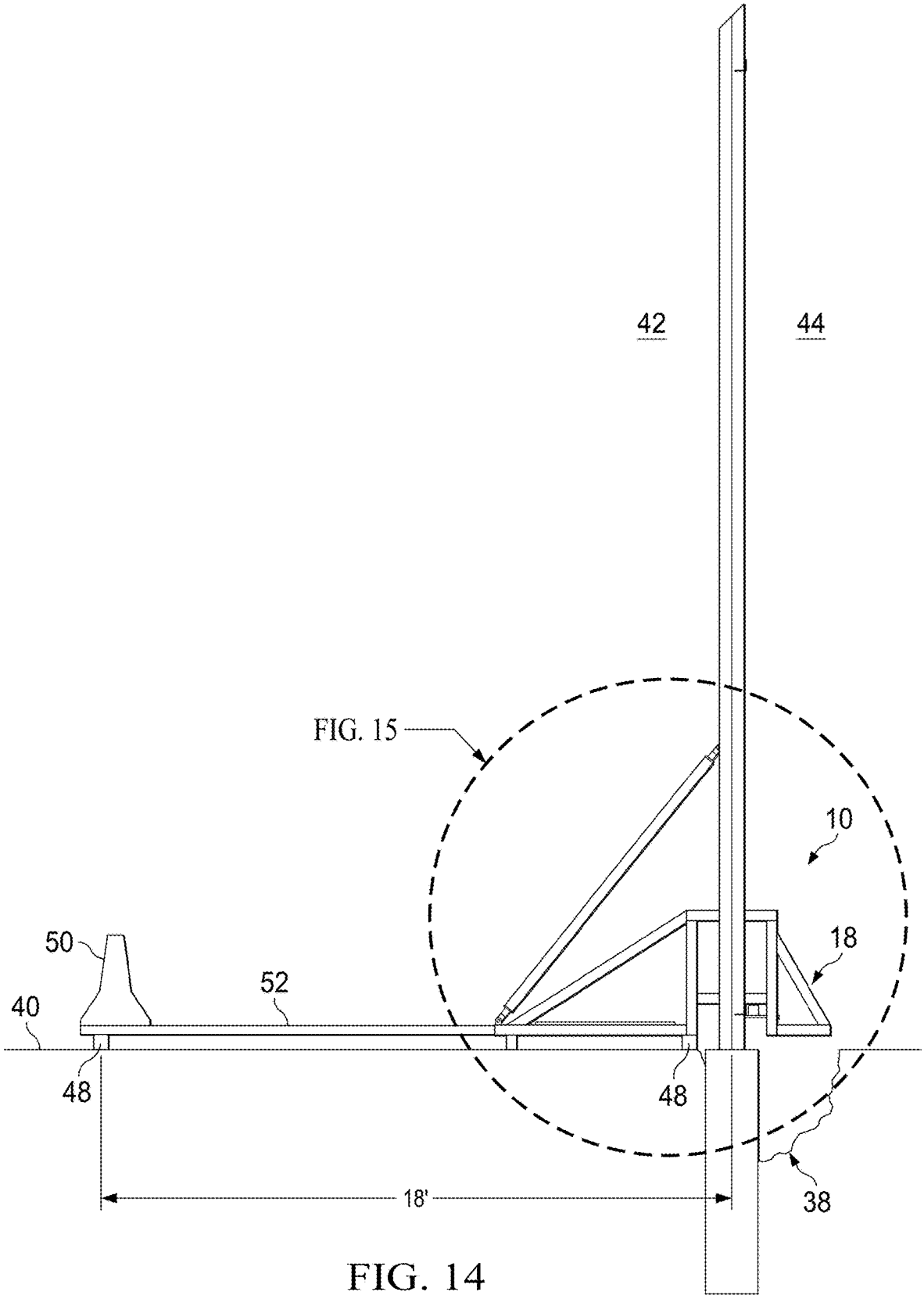
Figure 15:
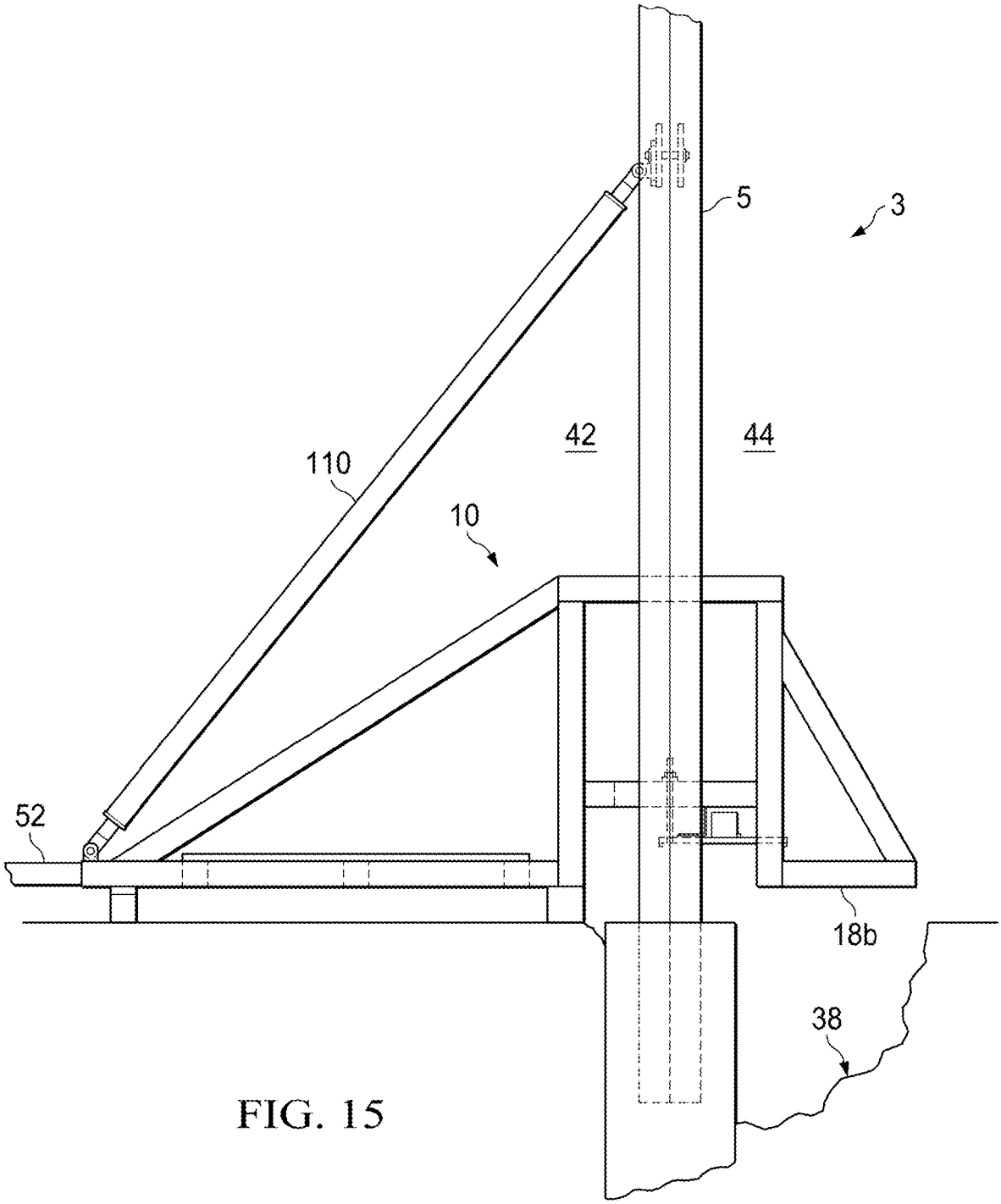

FIGS. 13 through 15 illustrate an example of using exemplary brace 10 to position and secure bollard panel 3 in a vertical position in a trench 38 that is caving on a side, e.g. side 44, to construct a bollard fence 56. In this situation, one or more of braces 10 are oriented as a cantilever to support bollard panel 3 in the desired vertical orientation. In this example, long longitudinal section 16 is positioned on side 42, opposite from the cave-in, and is secured by placement of a mass 50, e.g., a concrete Jersey barrier (400 lbs/foot), at a selected distance from bollard panel 3. Second longitudinal section 18 is suspended over the open trench 38 due to the cave in. As discussed above, horizontal leg **16*b* may be formed of hollow tubing and may be fitted with a horizontal extension 52 to increase the length of longitudinal section and increase the distance that mass 50 can be positioned from cantilevered longitudinal section 18. In an exemplary embodiment, extensions 52 are limited to extending ten feet to blocking 54. In the cantilever embodiment, extension 52 is lengthened to be fully inserted into bottom tube 16*b* of longitudinal section 16 and extends outward to the desired blocking distance. In a non-limiting example, the blocking distance and proximate positioning of mass 50 is 18 feet from bollard panel 3**.

Figure 16:
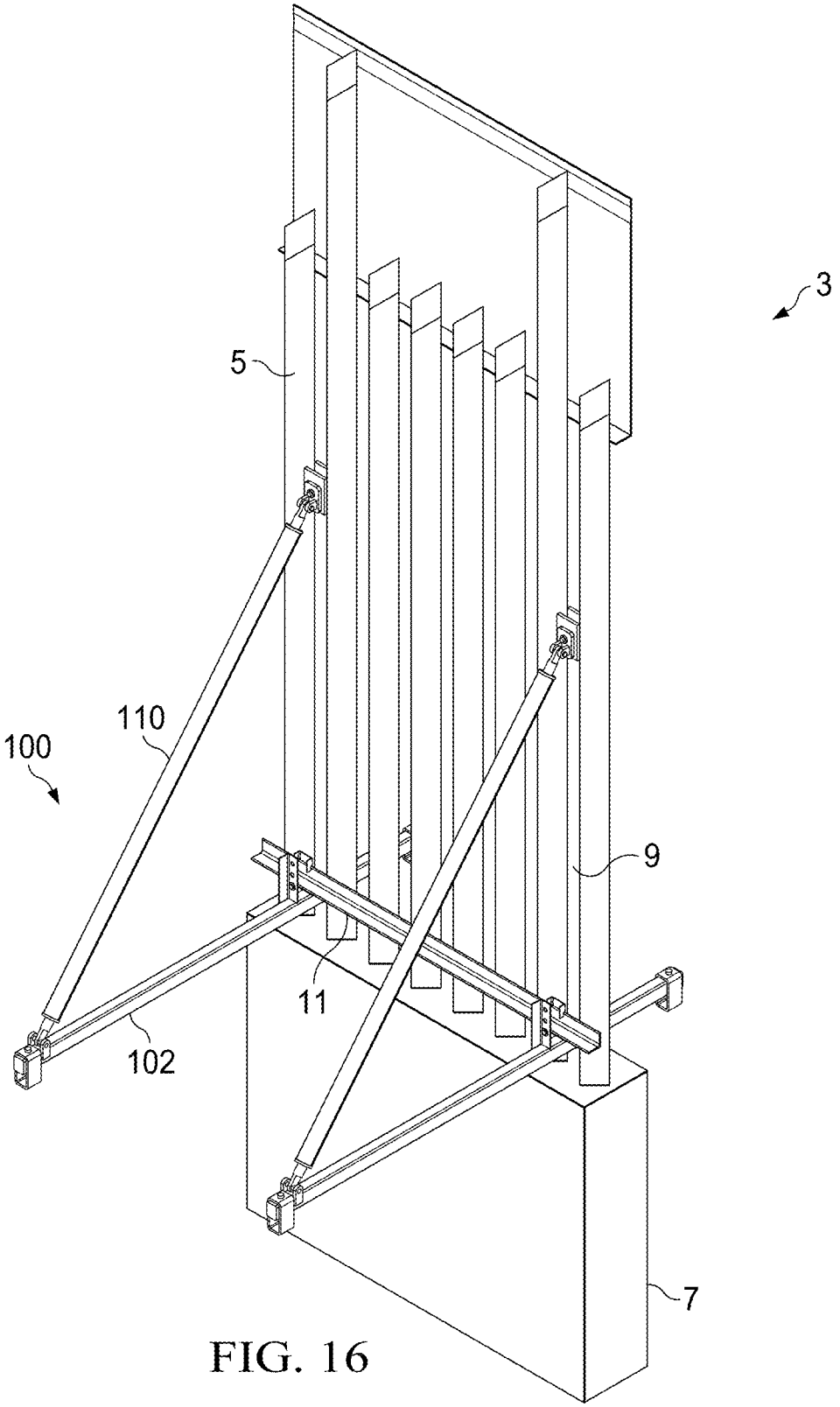
FIG. 16 is an isometric view of another exemplary embodiment of bollard panel braces supporting an example bollard panel in a vertical position.
Figure 17:
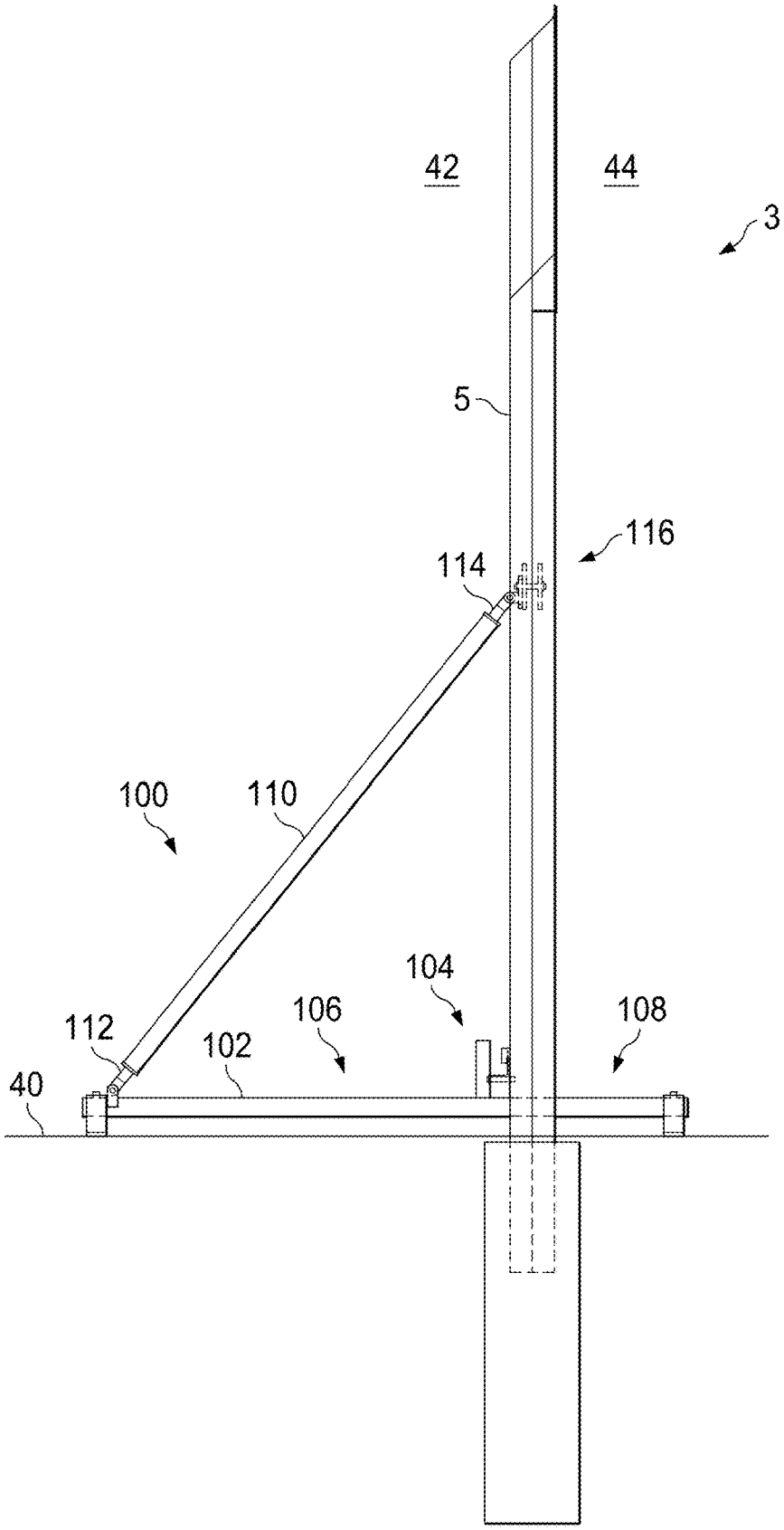
FIG. 17 is a side view of exemplary bollard panel braces in use.
Figure 18:
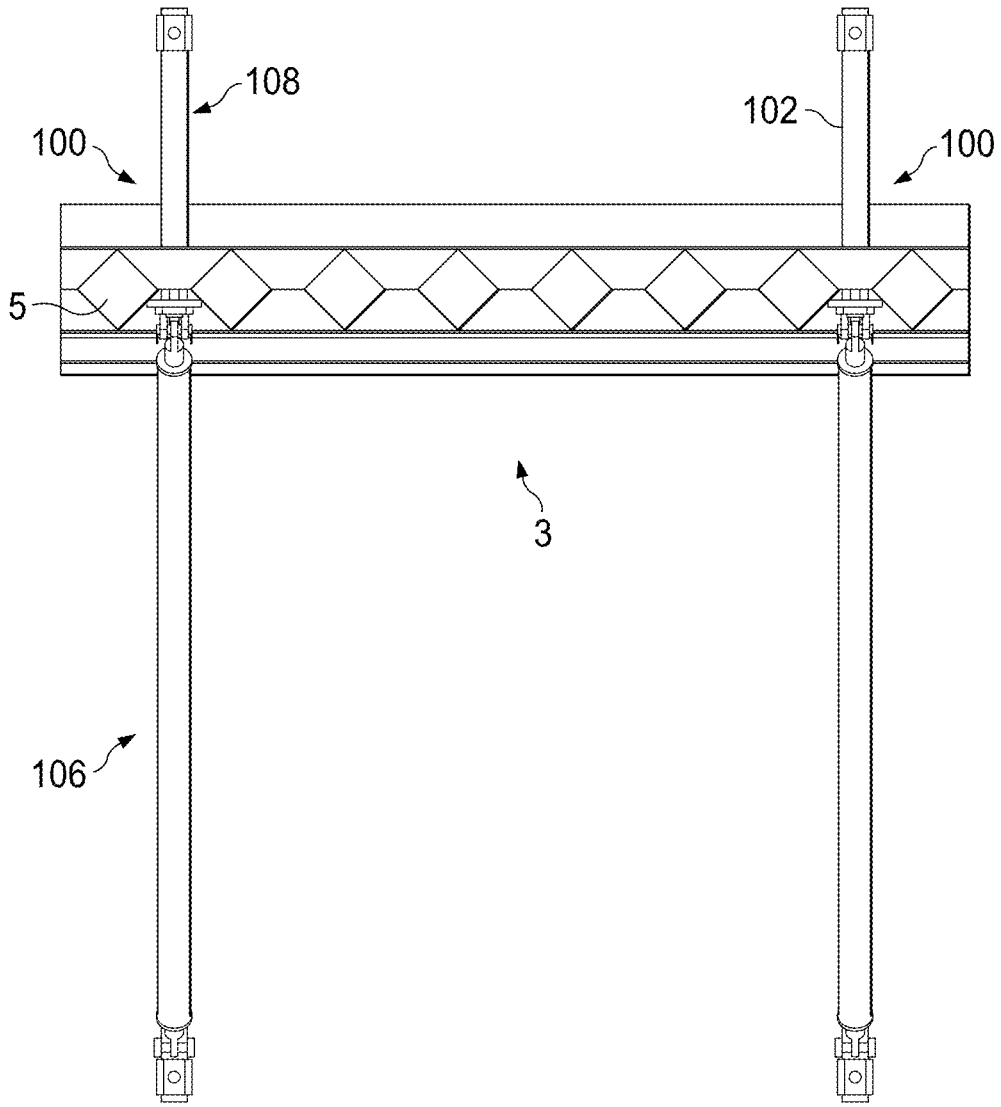
FIG. 18 is a plan view of exemplary bollard panel braces in use.
Figure 19:
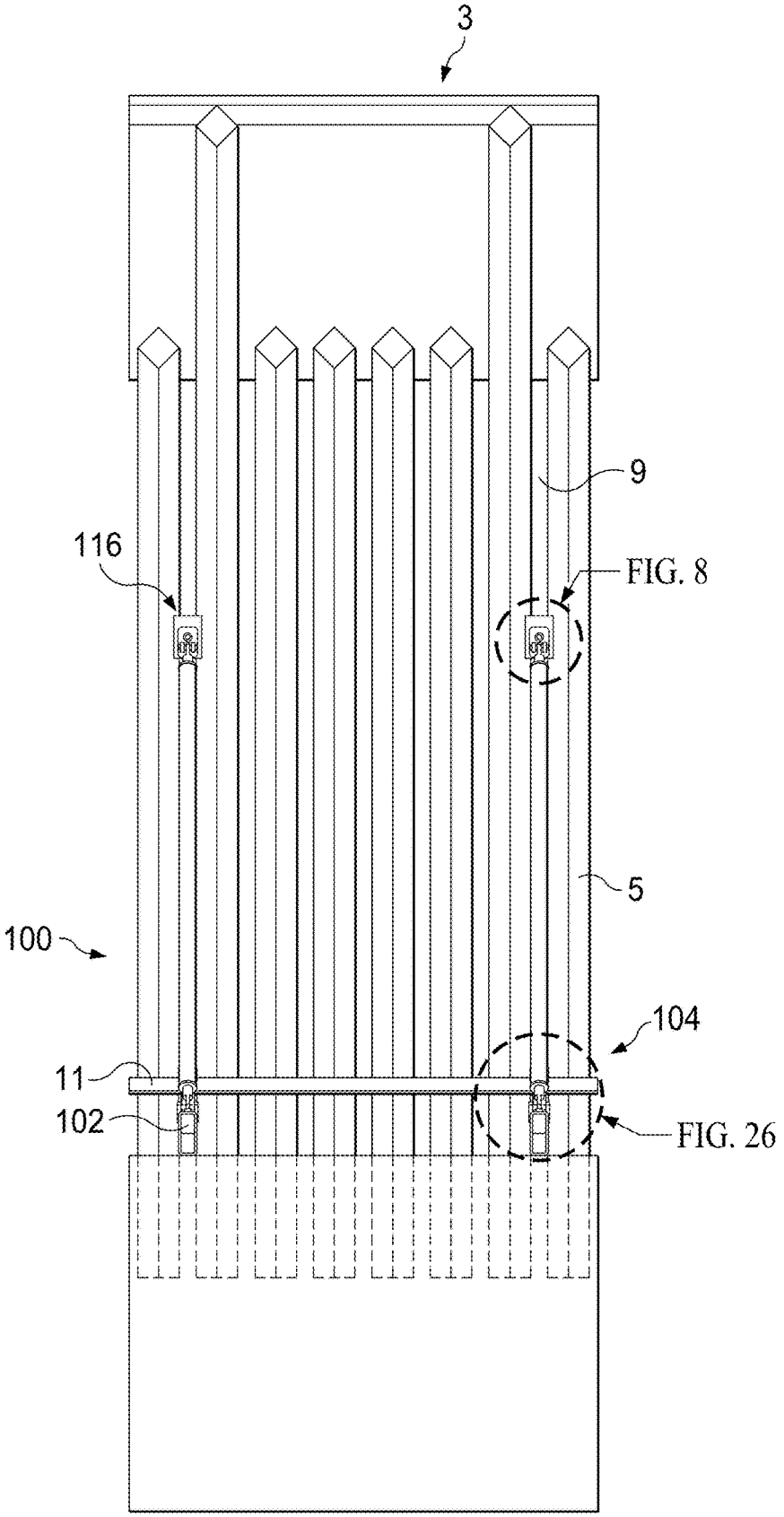
FIG. 19 is a front view of exemplary bollard panel braces in use.

FIGS. 16 to 28 illustrate another exemplary embodiment of a bollard panel brace, generally denoted by the reference number 100. FIG. 16 illustrates a pair of braces 100 supporting a bollard panel 3 in a vertical position. As will be understood by those skilled in the art with the benefit of this disclosure, brace 100 can be used to support bollard panel 3 in the vertical position while a bollard wall or fence is being constructed. The illustrated bollard panel 3 is a non-limiting example of a bollard panel. Bollard panel 3 includes a plurality of bollards 5 (e.g., tube, circular pipe, hollow structural steel) that are spaced apart from one another and extend from a bottom end that is secured for example in a concrete base 7 positioned below ground when erected as a barrier. A gap 9 between the spaced apart bollards 5 is limited in size to mitigate the ability of people to pass between the adjacent bollards.

Braces 100 include a longitudinal member 102, constructed in the illustrated example by a 4 inch by 3 inch by 0.188 inch hollow structural steel (HSS), and a lower panel connector 104. Lower panel connector 104 is located on a top or bottom surface of longitudinal member 102 separating longitudinal member 102 into a first leg 106 and a second leg 108. In use, longitudinal member 102 is positioned in a gap 9 in bollard panel 3 with first leg 106 extending on one side 42 of bollard panel 3 and second leg 108 extending on the other side 44 of bollard panel 3. Panel connector 104 secures longitudinal member 102 to bollard panel 3.

Figure 20:
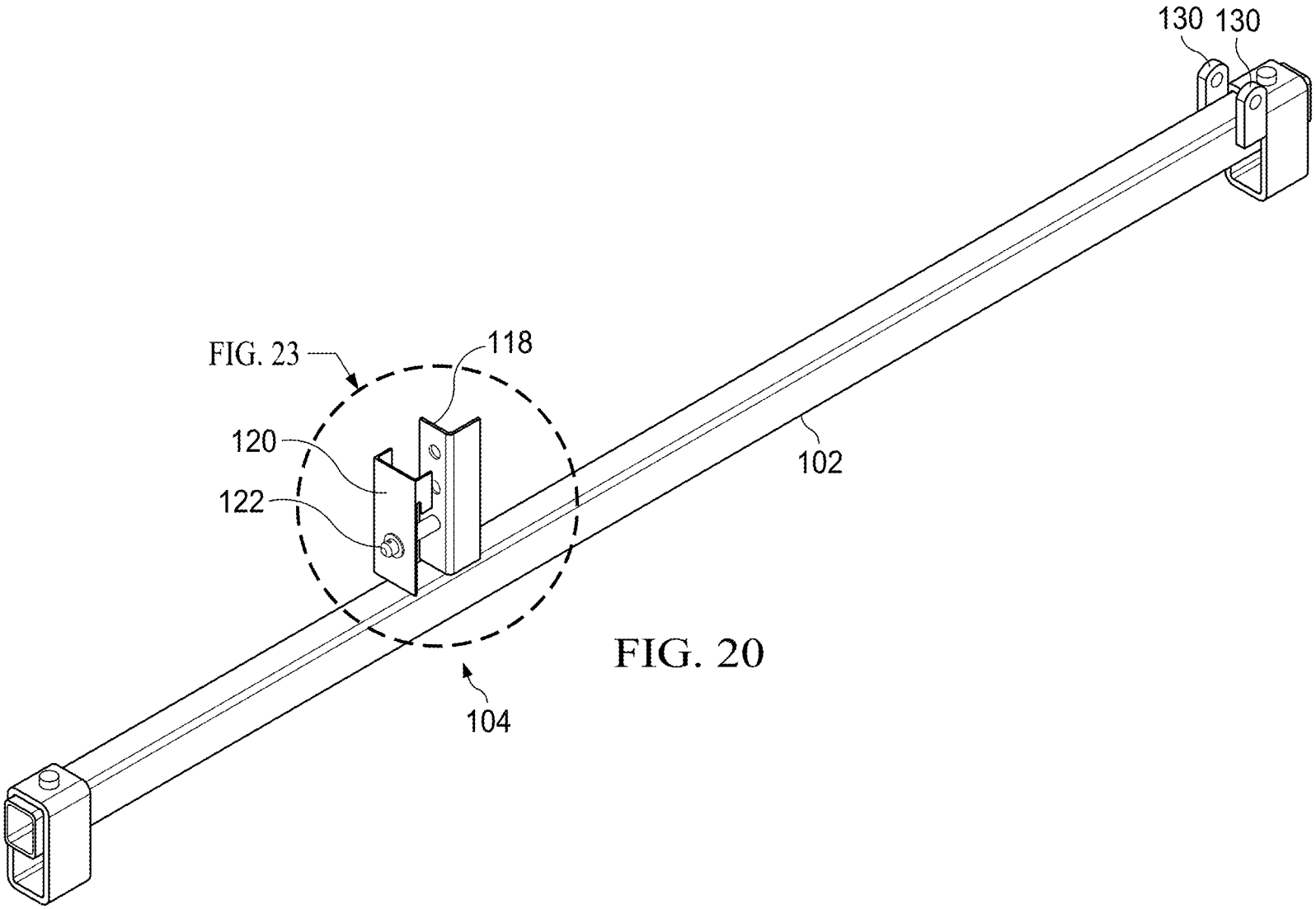
FIGS. 20-22 are views of a longitudinal brace member of an exemplary bollard panel brace.
Figure 21:
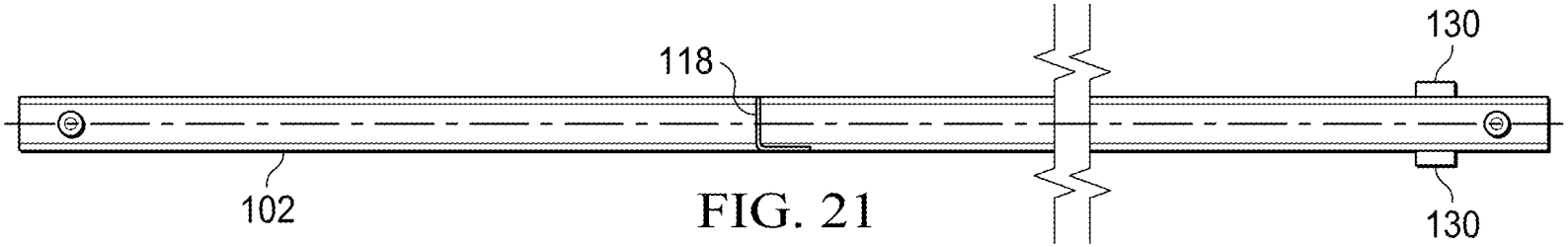
Figure 22:
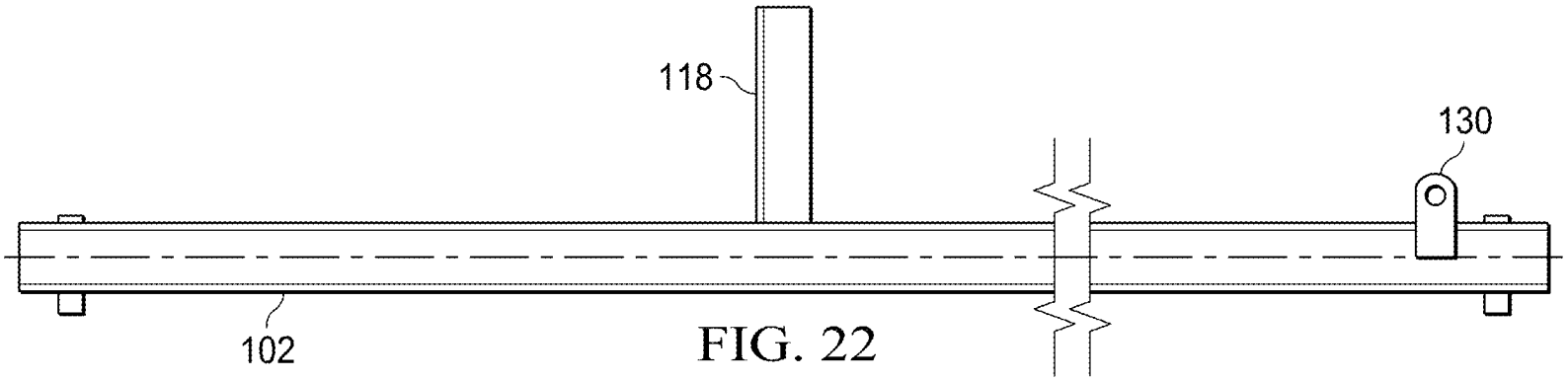
Figure 23:
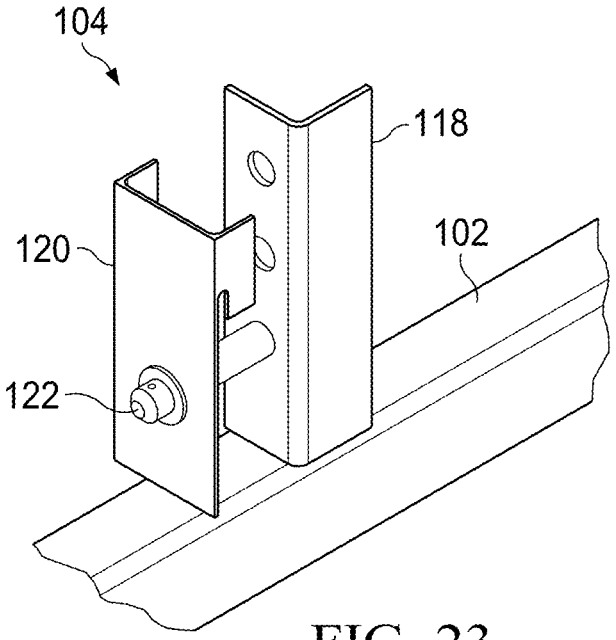
FIG. 23 is an exploded view of an exemplary lower panel connector.
Figure 24:
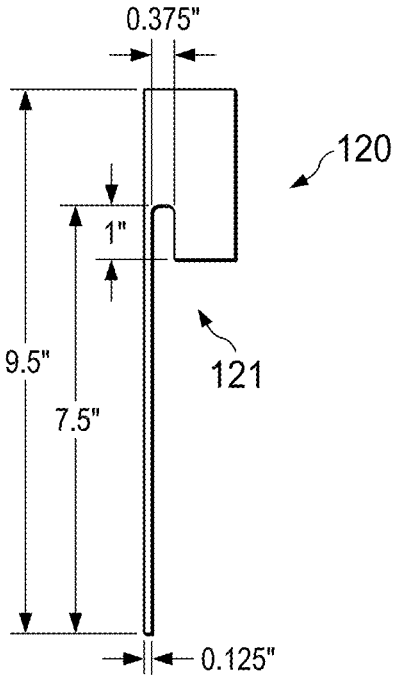
FIG. 24 illustrates an example panel connector in accordance to an aspect of the disclosure.

Brace 100 may include a diagonal brace 110 extending from a bottom end 112 attached to longitudinal member 102 on first or second leg 106, 108 and top end 114 having an upper panel connector 116 configured to attach to bollard panel 3. Bottom end 112 is hinged or pivotally attached to longitudinal member 102 at tab plates 130 (FIGS. 20-22). A non-limiting example of upper panel connector 116 is shown in FIGS. 8 and 9.

Figure 25:
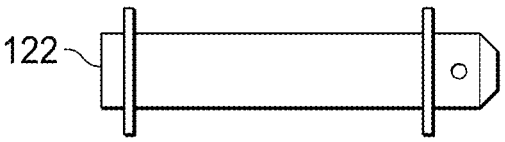
FIG. 25 illustrates an example of a rod for interconnecting a moveable jaw with a non-moveable jaw of a panel connector.
Figure 26:
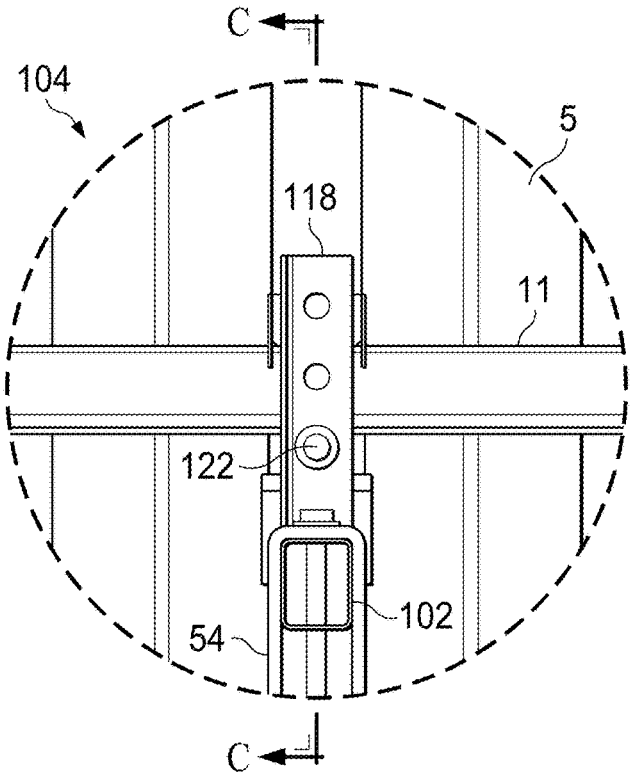
FIG. 26 is a front view of an exemplary lower panel connector of FIG. 19.
Figure 27:
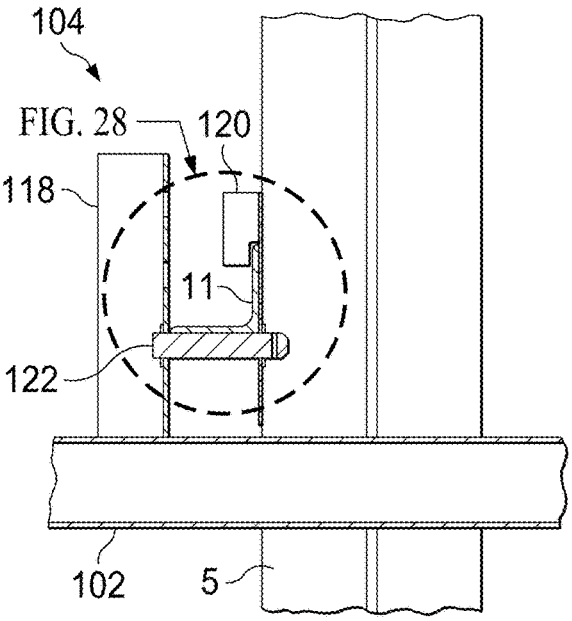
FIG. 27 illustrates the lower panel connector along the line C-C of FIG. 26.
Figure 28:
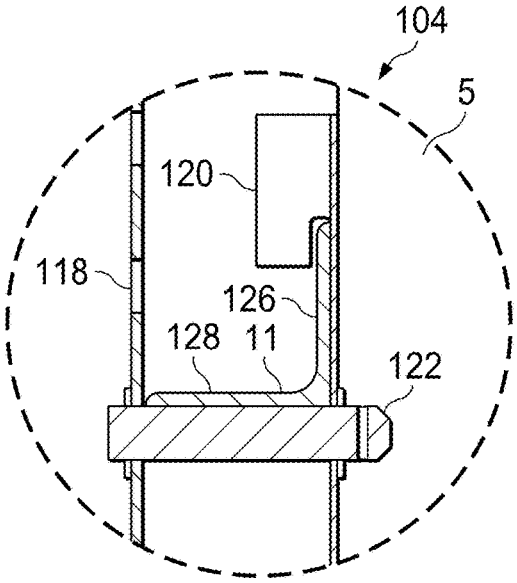
FIG. 28 is an exploded view of the lower panel connector of FIG. 27.

FIGS. 20 and 22-28 illustrate an exemplary embodiment of a panel connector, used as lower panel connector 104 in the depicted embodiments. Panel connector 104 includes a fixed jaw 118 attached to a moveable jaw 120 via rod 122. Rod 122 is illustrated in FIG. 25 as a lock pin and is configured for an embodiment where the distance between fixed jaw 118 and moveable jaw 120 in the locked, secured, position is known and fixed. In some embodiments, rod 122 may be a screw or sliding bar so that the distance between jaws 118 and 120 in the locked, secured, position can be adjusted.

Panel connector 104 is configured to attach brace 100 to bollard panel 3 via a lateral support 11, see, e.g., FIGS. 16 and 26-28, having a vertical leg 126 and a horizontal leg 128. For example, lateral support 11 may be constructed of angle iron. Lateral support 11 has a length at least sufficient to span across gap 9 and is secured to bollards 5, for example by welding. In the illustrated example, lateral support 11 is oriented with vertical leg 126 in direct contact with bollards 5 and extending upward relative horizontal leg 128, which is extending outward from the bollards 5. Lateral support 11 may be oriented in other directions without departing from the scope of this disclosure. Moveable jaw 120 is formed as a c-clip having slot 121 (FIG. 24) for disposing a portion of lateral support 11.

As will be understood by those skilled in the art with the benefit of this disclosure, the lower panel connector 104 may be configured in other manners such as shown at FIGS. 8 and 9 with reference to upper panel connector 116 or panel connector 12 illustrated in FIGS. 2, 6, and 7. Similarly, the panel connector illustrated in FIGS. 2, 6, and 7 may be substituted with the connector illustrated as lower panel connector 104 or upper panel connector 116.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include such elements or features.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms such as "inboard," "outboard," "above," "below," "upper," "lower," or other like terms to describe a spatial relationship between various components or to describe the spatial orientation of aspects of such components should be understood to describe a relative relationship between the components or a spatial orientation of aspects of such components, respectively, as the device described herein may be oriented in any desired direction. As used herein, the terms "connect," "connection," "connected," "in connection with," and "connecting" may be used to mean in direct connection with or in connection with via one or more elements. Similarly, the terms "couple," "coupling," and "coupled" may be used to mean directly coupled or coupled via one or more elements.

The term "substantially," "approximately," and "about" is defined as largely but not necessarily wholly what is specified (and includes what is specified; e.g., substantially 90 degrees includes 90 degrees and substantially parallel includes parallel), as understood by a person of ordinary skill in the art. The extent to which the description may vary will depend on how great a change can be instituted and still have a person of ordinary skill in the art recognized the modified feature as still having the required characteristics and capabilities of the unmodified feature. In general, but subject to the preceding, a numerical value herein that is modified by a word of approximation such as "substantially," "approximately," and "about" may vary from the stated value, for example, by 0.1, 0.5, 1, 2, 3, 4, 5, 10, or 15 percent.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure and that they may make various changes, substitutions, and alterations without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A method for supporting a bollard panel in a vertical position for installing the bollard panel in the ground, the method comprising:

positioning a bottom end of the bollard panel in an open trench, the bollard panel comprising adjacent bollards, a gap between the adjacent bollards, and a lateral support attached to the adjacent bollards; and using a brace to support the bollard panel in the open trench, the brace comprising a linear structure having an arch section that includes a panel connector, a first longitudinal section extending in a first axial direction away from the arch section, and a second longitudinal section extending in a second axial direction away from the arch section, wherein the panel connector is attached to the bollard panel and the brace extends generally perpendicular to the bollard panel with the first longitudinal section located on a first side of the bollard panel and the second longitudinal section located on a second side of the bollard panel, and at least one of the first longitudinal section and the second longitudinal section contacting the ground.

2. The method of claim 1, wherein the panel connector comprises a fixed jaw and a moveable jaw and the panel connector is attached to the lateral support.

3. The method of claim 1, wherein the first and second longitudinal sections are triangular shaped.

4. The method of claim 1, wherein the first longitudinal section comprises a vertical leg, a horizontal leg, and a hypotenuse leg arranged in a right triangle; and the second longitudinal section comprises a vertical leg, a horizontal leg, and a hypotenuse leg arranged in a right triangle.

5. The method of claim 4, wherein the panel connector comprises a fixed jaw and a moveable jaw.

6. The method of claim 4, wherein the horizontal leg of the first longitudinal section and the horizontal leg of the second longitudinal section have different lengths.

7. The method of claim 4, wherein the arch section comprises the vertical legs of the first and the second longitudinal sections;

a horizontal member extending between the vertical legs of the first and the second longitudinal sections; and the panel connector comprises the horizontal member.

8. The method of claim 7, wherein the panel connector comprises a fixed jaw and a moveable jaw and the panel connector is attached to the lateral support.

9. The method of claim 8, wherein the horizontal member is the fixed jaw.

10. The method of claim 7, wherein the horizontal leg of the first longitudinal section and the horizontal leg of the second longitudinal section have different lengths.

11. The method of claim 10, wherein the panel connector comprises a fixed jaw and a moveable jaw and the panel connector is attached to the lateral support.

12. The method of claim 11, wherein the horizontal member is the fixed jaw.

13. A method for supporting a bollard panel in a vertical position while installing the bollard panel in the ground, the method comprising:

using a brace comprising a linear member carrying a lower panel connector that separates a first longitudinal section from a second longitudinal section to support the bollard panel, the bollard panel comprising a bottom end positioned in a trench, adjacent bollards, and a gap between the adjacent bollards, wherein the lower panel connector is attached to the bollard panel with the brace extending generally perpendicular to the bollard panel with the first longitudinal section located on a first side of the bollard panel and the second longitudinal section located on a second side of the bollard panel, and at least one of the first longitudinal section and the second longitudinal section supported by the ground, and a diagonal member having a first end pivotally connected to the first longitudinal section and a second end attached to the bollard panel above the lower panel connector.

14. The method of claim 13, wherein the lower panel connector comprises a fixed jaw and a moveable jaw; and the lower panel connector is attached to a lateral support that is attached to the adjacent bollards.

15. A method, comprising:

installing a bollard panel in a bollard wall, the bollard panel comprising adjacent bollards and a gap between the adjacent bollards; and supporting, with a brace, the bollard panel in a vertical position relative to a ground with a bottom end of the bollard positioned in a trench, the brace comprising a panel connector, a first longitudinal section, and a second longitudinal section, wherein the brace is disposed in the gap with the first longitudinal section located on a first side of the bollard panel, the second longitudinal section located on a second side of the bollard panel, and the panel connector attached to the bollard panel.

16. The method of claim 15, wherein the panel connector is attached to a lateral support that is attached to the adjacent bollards.

17. The method of claim 15, wherein the brace comprises an arch section between the first longitudinal section and the second longitudinal section, the arch section comprising the panel connector.

18. The method of claim 17, wherein the first longitudinal section comprises a vertical leg, a horizontal leg, and a hypotenuse leg arranged in a right triangle; and the second longitudinal section comprises a vertical leg, a horizontal leg, and a hypotenuse leg arranged in a right triangle.

19. The method of claim 18, wherein the horizontal leg of the first longitudinal section and the horizontal leg of the second longitudinal section have different lengths.

20. The method of claim 19, wherein the panel connector is attached to a lateral support that is attached to the adjacent bollards.

* * * * *